US008893389B2

(12) United States Patent
Freeman

(10) Patent No.: US 8,893,389 B2
(45) Date of Patent: Nov. 25, 2014

(54) CANTILEVER SPRING ASSIST KNIFE

(75) Inventor: Jeff Freeman, Tigard, OR (US)

(73) Assignee: Fiskars Brands, Inc., Madison, WI (US)

( * ) Notice: Subject to any disclaimer, the term of this patent is extended or adjusted under 35 U.S.C. 154(b) by 367 days.

(21) Appl. No.: 13/149,648

(22) Filed: May 31, 2011

(65) Prior Publication Data

US 2012/0304470 A1 Dec. 6, 2012

(51) Int. Cl.
*B26B 3/06* (2006.01)
*B26B 1/00* (2006.01)
*B26B 1/04* (2006.01)

(52) U.S. Cl.
CPC ..... *B26B 1/046* (2013.01)
USPC ..... 30/155; 30/157; 30/159; 30/161

(58) Field of Classification Search
USPC ..... 30/159, 160, 161, 157, 155, 342, 337, 30/338, 153, 156
See application file for complete search history.

(56) References Cited

U.S. PATENT DOCUMENTS

| | | | |
|---|---|---|---|
| 273,858 | A | 3/1883 | Korn |
| 361,315 | A | 4/1887 | Nuessle |
| 492,620 | A | 2/1893 | Balston |
| 551,052 | A | 12/1895 | Shonnard et al. |
| 616,689 | A | 12/1898 | Ruettgers |
| 812,601 | A | 2/1906 | Schrade |
| 1,030,058 | A | 6/1912 | Doles |
| 1,087,788 | A | 2/1914 | Larsen |
| 1,258,150 | A | 3/1918 | Schrade |
| 1,357,398 | A | 11/1920 | Haywood |
| 1,454,665 | A | 5/1923 | Bobek |
| 1,603,914 | A | 10/1926 | Hermann |
| 1,614,949 | A | 1/1927 | Finley |
| 1,701,027 | A | 2/1929 | Brown |
| 1,743,022 | A | 1/1930 | Carman |
| 1,810,031 | A | 3/1930 | Schrade |
| 2,137,800 | A | 9/1937 | Davey |
| 2,197,136 | A | 4/1940 | Share et al. |

(Continued)

FOREIGN PATENT DOCUMENTS

| | | |
|---|---|---|
| AT | 407 503 B | 4/2001 |
| DE | 28765 | 1/1884 |

(Continued)

OTHER PUBLICATIONS

Bladetraders, www.kershawknives.com, Mar. 18, 2004, 2 pages.

(Continued)

*Primary Examiner* — Omar Flores Sanchez
(74) *Attorney, Agent, or Firm* — Foley & Lardner LLP

(57) ABSTRACT

A folding tool includes a handle and an implement pivotally coupled to the handle. The implement is adapted to travel between a closed position and an open position. The implement includes a tang having a contoured surface. The folding tool also includes a locking device movable between a locked position and an unlocked position along an axis that is transverse to a plane defined by the implement. The folding tool further includes a cantilever spring having a first end coupled to the handle and a second end adapted to interact with the tang of the implement. The spring exerts a closing force on the implement when the blade is in a closed position. The spring exerts an opening force on the implement during at least a portion of the travel of the implement between the closed position and the open position.

19 Claims, 12 Drawing Sheets

(56) References Cited

U.S. PATENT DOCUMENTS

| | | | | |
|---|---|---|---|---|
| 2,407,897 | A | 9/1946 | Newman | |
| 2,461,941 | A | 2/1949 | Sutton | |
| 3,315,356 | A | 4/1967 | Swanke et al. | |
| 3,418,713 | A | 12/1968 | Bauer | |
| 3,750,283 | A | 8/1973 | Hoffman | |
| 3,868,774 | A | 3/1975 | Miori | |
| 3,943,934 | A | 3/1976 | Bent | |
| 3,977,079 | A | 8/1976 | Rebold | |
| 4,011,657 | A | 3/1977 | Vance | |
| 4,028,806 | A | 6/1977 | Sheldon | |
| 4,040,181 | A | 8/1977 | Johnson | |
| 4,068,375 | A | 1/1978 | Rathbun et al. | |
| 4,133,106 | A | 1/1979 | Addis | |
| 4,173,071 | A | 11/1979 | Ishida | |
| 4,177,560 | A | 12/1979 | Sakurai | |
| 4,218,819 | A | 8/1980 | Phelps | |
| 4,233,737 | A | 11/1980 | Poehlmann | |
| 4,249,306 | A | 2/1981 | Benson | |
| 4,268,960 | A | 5/1981 | Reinschreiber | |
| 4,274,200 | A | 6/1981 | Coder | |
| 4,391,043 | A | 7/1983 | Sizemore et al. | |
| 4,404,748 | A | 9/1983 | Wiethoff | |
| 4,408,394 | A | 10/1983 | Phelps | |
| 4,442,600 | A | 4/1984 | Felix-Dalichow | |
| 4,451,981 | A | 6/1984 | Kaniarz | |
| 4,451,982 | A | 6/1984 | Collins | |
| 4,509,260 | A | 4/1985 | Gringer | |
| 4,535,539 | A | 8/1985 | Friedman et al. | |
| 4,541,175 | A | 9/1985 | Boyd et al. | |
| 4,570,341 | A | 2/1986 | Konneker | |
| 4,573,268 | A | 3/1986 | Call | |
| 4,604,803 | A | 8/1986 | Sawby | |
| 4,612,706 | A | 9/1986 | Yunes | |
| 4,669,188 | A | 6/1987 | Evrell | |
| 4,670,984 | A | 6/1987 | Rickard | |
| 4,750,267 | A | 6/1988 | Boyd | |
| 4,757,612 | A | 7/1988 | Peyrot | |
| 4,776,094 | A | 10/1988 | Glesser | |
| 4,802,279 | A | 2/1989 | Rowe | |
| 4,805,303 | A | 2/1989 | Gibbs | |
| 4,811,486 | A | 3/1989 | Cunningham | |
| 4,817,284 | A | 4/1989 | Sacherman et al. | |
| 4,837,932 | A | 6/1989 | Elsener | |
| 4,947,552 | A | 8/1990 | Barnes | |
| 4,974,323 | A | 12/1990 | Cassady | |
| 4,989,320 | A | 2/1991 | Borkott et al. | |
| 5,025,557 | A | 6/1991 | Perreault | |
| 5,033,987 | A | 7/1991 | Bloch | |
| 5,044,079 | A | 9/1991 | Gibbs | |
| 5,092,045 | A | 3/1992 | Boyd, Jr. et al. | |
| 5,095,624 | A | 3/1992 | Ennis | |
| 5,111,581 | A | 5/1992 | Collins | |
| 5,131,149 | A | 7/1992 | Thompson et al. | |
| 5,210,950 | A | 5/1993 | Rankl | |
| D336,602 | S | 6/1993 | Thompson et al. | |
| 5,250,063 | A | 10/1993 | Abidin | |
| 5,283,954 | A | 2/1994 | Szabo | |
| 5,303,474 | A | 4/1994 | Keklak et al. | |
| 5,331,741 | A | 7/1994 | Taylor, Jr. | |
| 5,400,509 | A | 3/1995 | Collins | |
| 5,437,101 | A | 8/1995 | Collins | |
| 5,502,895 | A | 4/1996 | Lemaire | |
| 5,511,310 | A | 4/1996 | Sessions et al. | |
| 5,515,610 | A | 5/1996 | Levin et al. | |
| 5,522,138 | A | 6/1996 | Betts, Jr. | |
| 5,581,893 | A | 12/1996 | Ouellette | |
| D377,744 | S | 2/1997 | Hasegawa | |
| 5,615,484 | A | 4/1997 | Pittman | |
| 5,647,129 | A | 7/1997 | Stamper | |
| 5,685,079 | A | 11/1997 | Brothers et al. | |
| 5,692,304 | A | 12/1997 | Campbell | |
| 5,699,615 | A | 12/1997 | Chen | |
| 5,729,904 | A | 3/1998 | Trott | |
| 5,737,841 | A | 4/1998 | McHenry et al. | |
| 5,755,035 | A | 5/1998 | Weatherly | |
| 5,765,247 | A | 6/1998 | Seber et al. | |
| 5,769,094 | A | 6/1998 | Jenkins, Jr. et al. | |
| 5,781,998 | A | 7/1998 | Stamper | |
| 5,794,346 | A | 8/1998 | Seber et al. | |
| 5,802,722 | A | 9/1998 | Maxey et al. | |
| 5,815,927 | A | 10/1998 | Collins | |
| 5,819,414 | A | 10/1998 | Marifone | |
| 5,822,866 | A | 10/1998 | Pardue | |
| 5,826,340 | A | 10/1998 | Hull | |
| 5,887,347 | A | 3/1999 | Gibbs | |
| 5,915,792 | A | 6/1999 | Sakurai | |
| 5,926,959 | A | 7/1999 | Collins | |
| 5,964,035 | A | 10/1999 | Poehlmann | |
| 5,964,036 | A | 10/1999 | Centofante | |
| 6,079,106 | A | 6/2000 | Vallotton | |
| 6,088,860 | A | 7/2000 | Poehlmann et al. | |
| 6,101,722 | A | 8/2000 | Cheng | |
| 6,101,723 | A | 8/2000 | Ford | |
| 6,101,724 | A | 8/2000 | Halligan | |
| 6,105,255 | A | 8/2000 | Cheng | |
| 6,122,829 | A | 9/2000 | McHenry et al. | |
| 6,125,543 | A | 10/2000 | Jhones | |
| 6,131,292 | A | 10/2000 | Reddig | |
| 6,145,202 | A | 11/2000 | Onion | |
| 6,148,522 | A | 11/2000 | Dobandi | |
| 6,158,127 | A | 12/2000 | Taylor | |
| 6,170,158 | B1 | 1/2001 | Daily | |
| D438,085 | S | 2/2001 | Onion | |
| 6,256,888 | B1 | 7/2001 | Shuen | |
| 6,260,281 | B1 | 7/2001 | Okumura et al. | |
| 6,263,581 | B1 | 7/2001 | Forte | |
| 6,276,063 | B1 | 8/2001 | Chen | |
| 6,289,592 | B1 | 9/2001 | Emerson | |
| 6,305,085 | B1 | 10/2001 | Stallegger et al. | |
| 6,308,418 | B1 | 10/2001 | Sweet | |
| 6,308,420 | B1 | 10/2001 | Moser | |
| D450,228 | S | 11/2001 | Onion | |
| 6,327,780 | B1 | 12/2001 | Bigham et al. | |
| 6,330,749 | B1 | 12/2001 | Khachatoorian et al. | |
| 6,338,431 | B1 | 1/2002 | Onion | |
| D454,043 | S | 3/2002 | Onion | |
| D454,768 | S | 3/2002 | Onion | |
| 6,360,443 | B1 | 3/2002 | Remus | |
| D455,062 | S | 4/2002 | Onion | |
| 6,367,154 | B2 | 4/2002 | Degabli | |
| 6,378,214 | B1 | 4/2002 | Onion | |
| 6,397,476 | B1 | 6/2002 | Onion | |
| 6,397,477 | B1 | 6/2002 | Collins | |
| 6,427,334 | B2 | 8/2002 | Onion | |
| 6,430,816 | B2 | 8/2002 | Neveux | |
| 6,434,831 | B2 | 8/2002 | Chen | |
| 6,438,848 | B1 | 8/2002 | McHenry et al. | |
| D474,669 | S | 5/2003 | Onion | |
| 6,574,869 | B1 | 6/2003 | McHenry et al. | |
| 6,591,504 | B2 | 7/2003 | Onion | |
| 6,638,290 | B2 | 10/2003 | Pascaloff et al. | |
| 6,651,344 | B2 * | 11/2003 | Cheng | 30/159 |
| 6,729,029 | B1 | 5/2004 | Chu | |
| 6,834,432 | B1 | 12/2004 | Taylor | |
| 7,086,157 | B2 | 8/2006 | Vallotton | |
| 7,146,736 | B1 * | 12/2006 | Collins | 30/160 |
| 7,182,001 | B2 | 2/2007 | Rivera | |
| 7,275,321 | B2 * | 10/2007 | Cheng | 30/160 |
| 7,284,329 | B1 * | 10/2007 | King | 30/161 |
| 7,293,360 | B2 | 11/2007 | Steigerwalt et al. | |
| 7,302,760 | B2 * | 12/2007 | Lake | 30/161 |
| 7,458,159 | B2 * | 12/2008 | Galyean et al. | 30/160 |
| 7,480,997 | B2 * | 1/2009 | Ping | 30/161 |
| 7,555,839 | B2 * | 7/2009 | Koelewyn | 30/160 |
| 7,562,454 | B2 * | 7/2009 | Steigerwalt et al. | 30/160 |
| 7,918,028 | B2 | 4/2011 | Steigerwalt et al. | |
| 2002/0066187 | A1 | 6/2002 | Jennings | |
| 2002/0104220 | A1 | 8/2002 | Marfione | |
| 2003/0070299 | A1 | 4/2003 | Frazer | |
| 2003/0079353 | A1 | 5/2003 | Lovell et al. | |
| 2003/0140500 | A1 | 7/2003 | Cheng | |
| 2004/0020058 | A1 | 2/2004 | Vallotton | |
| 2004/0088865 | A1 | 5/2004 | Onion | |

(56) References Cited

U.S. PATENT DOCUMENTS

| | | | |
|---|---|---|---|
| 2005/0137911 | A1 | 6/2005 | Conn et al. |
| 2005/0252010 | A1 | 11/2005 | Freeman |
| 2006/0064877 | A1 | 3/2006 | Vallotton |

FOREIGN PATENT DOCUMENTS

| | | | |
|---|---|---|---|
| DE | 29469 | | 6/1884 |
| DE | 1 104 386 | | 4/1961 |
| DE | 80 26 334 | U1 | 3/1981 |
| DE | 81 00 727 | U1 | 6/1981 |
| DE | 30 37 588 | A1 | 5/1982 |
| DE | 31 36 325 | A1 | 8/1982 |
| DE | 34 01 600 | A1 | 8/1984 |
| DE | 85 09 897 | U1 | 11/1985 |
| DE | 38 34 295 | A1 | 7/1989 |
| DE | 90 02 788 | U1 | 6/1990 |
| DE | 91 03 272 | U1 | 8/1991 |
| DE | 92 06 459 | U1 | 10/1993 |
| DE | 297 00 413 | U1 | 4/1997 |
| DE | 196 20 977 | A1 | 11/1997 |
| DE | 298 06 743 | U1 | 9/1998 |
| DE | 198 01 460 | A1 | 10/1998 |
| DE | 197 57 860 | C1 | 1/1999 |
| DE | 198 37 901 | A1 | 5/1999 |
| DE | 299 20 133 | A2 | 3/2000 |
| DE | 200 09 874 | U1 | 10/2000 |
| DE | 200 13 424 | U1 | 1/2001 |
| DE | 201 01 695 | U1 | 6/2001 |
| EP | 1 114 701 | A2 | 7/2001 |
| FR | 493.741 | | 8/1919 |
| FR | 1.069.862 | | 7/1954 |
| FR | 1.171.740 | | 1/1959 |
| FR | 1.248.117 | | 10/1960 |
| GB | 2 134 836 | A | 8/1984 |
| JP | 9-122359 | A | 5/1997 |
| JP | 11-216274 | A | 8/1999 |
| WO | WO 99/52687 | A1 | 10/1999 |
| WO | WO 99/58302 | A1 | 11/1999 |
| WO | WO 2004/033163 | A2 | 4/2004 |

OTHER PUBLICATIONS

Bolt-Action Knives, Gerber Legendary Blades Catalog, 1994, 1 page.

Gator® Exchange-A-Blade™ Saw, Product No. 6047, believed to have been available prior to May 17, 2004, 1 page.

Katz Knives, Inc., Symbol of Quality Knives, Katz Knives Catalog, 2003, 2 pages.

Safari Kit, www.katzknives.com, Mar. 18, 2004, 3 pages.

International Search Report for International Application No. PCT/US2003/31745, mail date May 7, 2004, 6 pages.

Office Action for U.S. Appl. No. 10/530,958, mail date Apr. 13, 2007, 12 pages.

Office Action for U.S. Appl. No. 10/847,239, mail date May 24, 2006, 7 pages.

Office Action for U.S. Appl. No. 10/847,239, mail date Oct. 6, 2006, 7 pages.

Office Action for U.S. Appl. No. 10/847,239, mail date Feb. 12, 2007, 6 pages.

Office Action for U.S. Appl. No. 10/847,239, mail date Jun. 4, 2007, 7 pages.

Office Action for U.S. Appl. No. 10/847,239, mail date Sep. 18, 2007, 7 pages.

Office Action for U.S. Appl. No. 10/847,239, mail date Jan. 24, 2008, 8 pages.

First Office Action and the English Translation for CN Application 201210179274.2, date of issue Jan. 30, 2014, 24 pages.

* cited by examiner

CANTILEVER SPRING ASSIST KNIFE

BACKGROUND

The present invention relates to a folding knife. In particular, the present invention relates to a folding knife having a cantilever spring to assist a user in opening the knife and a plunge lock to lock the knife in an open position.

Folding knives typically include a handle and one or more blades pivotally attached to the handle, the blades having a compact closed position and an extended open position. Additional features are added to folding knives in order to make such knives more useful and easier to operate. Such features may include a mechanism used to assist the user in opening the knife, a mechanism used to lock the blade into an open position, and a mechanism to bias the blade into the closed position. Adding additional features increases the cost and complexity of the folding knife. Cost considerations may outweigh the desire for additional features for folding knives that are intended for sale at moderate prices. Accordingly, there is a need for a mechanism that provides additional features that does not unacceptably raise manufacturing costs. Further, there is a need for such a mechanism that performs multiple desired functions using the same parts.

The components required to effectuate features such as an assisted opening function or a blade lock function utilize space in a folding knife that may otherwise be used for other purposes. Accordingly, there is need for a simplified mechanism that provides desirable features but does not utilize a great deal of space within a knife handle.

It would be desirable to provide a folding knife that includes a mechanism that provides one or more of these or other advantageous features. Other features and advantages will be made apparent from the present specification. The teachings disclosed extend to those embodiments that fall within the scope of the appended claims, regardless of whether they accomplish one or more of the aforementioned needs.

SUMMARY

One embodiment of the invention relates to a folding tool having a handle and an implement pivotally coupled to the handle. The implement is adapted to travel between a closed position and an open position. The implement includes a tang having a contoured surface. The folding tool also includes a locking device movable between a locked position and an unlocked position along an axis that is transverse to a plane defined by the implement. The folding tool further includes a cantilever spring having a first end coupled to the handle and a second end adapted to interact with the tang of the implement. The spring exerts a closing force on the implement when the blade is in a closed position. The spring exerts an opening force on the implement during at least a portion of the travel of the implement between the closed position and the open position.

Another embodiment of the invention relates a folding knife having a handle and a blade pivotally coupled to the handle. The blade has a closed position and an open position and includes a tang with a contoured surface. The folding knife also includes a locking device movable between a locked position and an unlocked position along an axis that is generally perpendicular to a plane defined by the blade. The folding knife further includes a spring located in the plane defined by the blade. The spring has a proximal end coupled to the handle and a distal end adapted to exert a force on the blade via contact with the contoured surface.

The invention is capable of other embodiments and of being practiced or carried out in various ways. Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION

Figure 1:
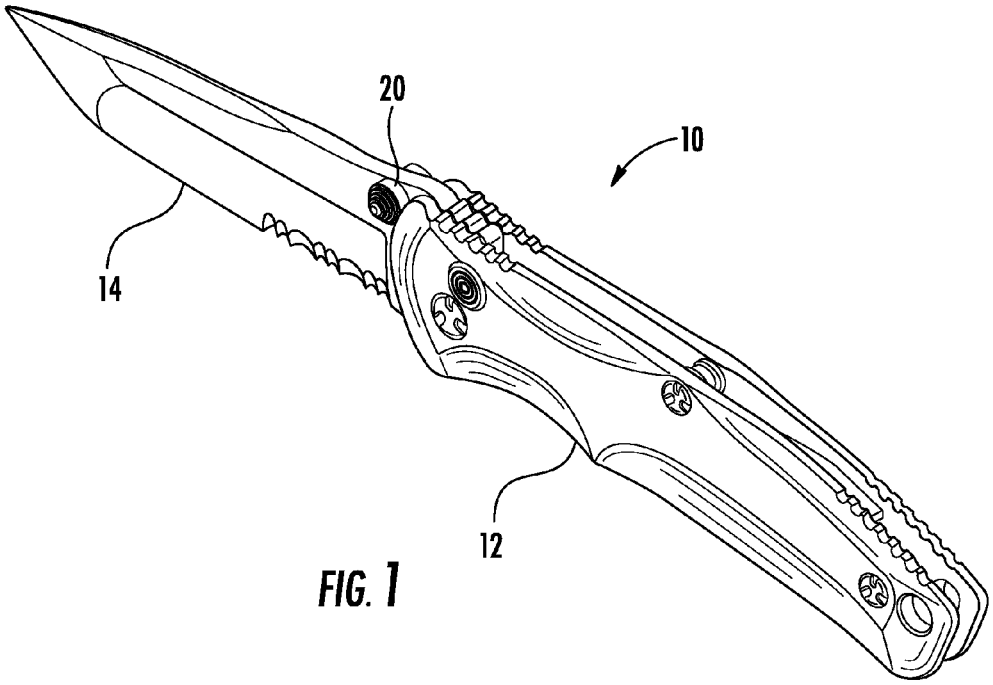
FIG. 1 is a perspective view of a folding knife with a blade in an open position according to an exemplary embodiment.
Figure 2:
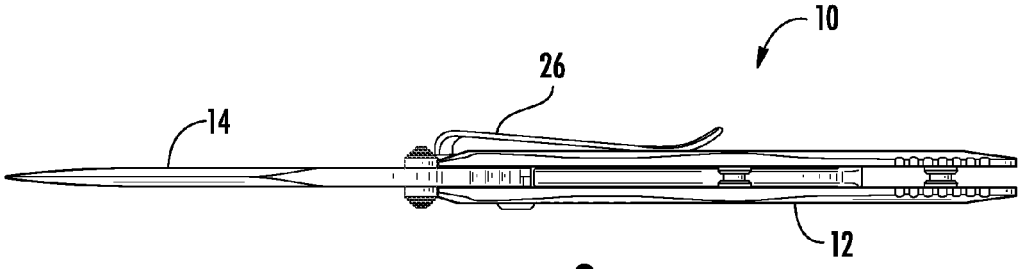
FIG. 2 is a top view of the folding knife of FIG. 1 according to an exemplary embodiment.
Figure 3:
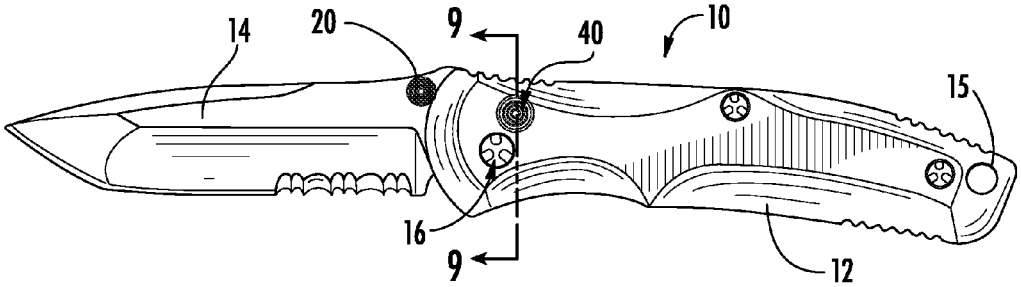
FIG. 3 is a left side view of the folding knife of FIG. 1 according to an exemplary embodiment.
Figure 4:
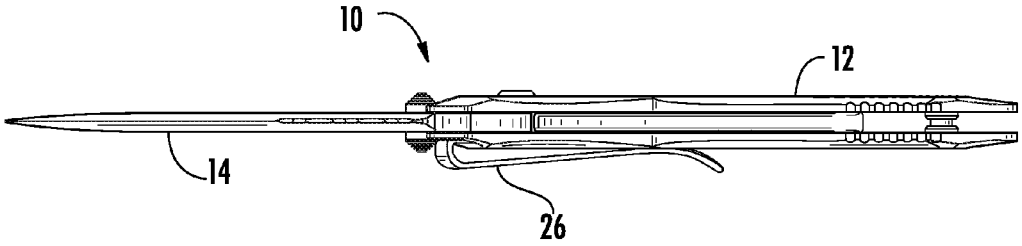
FIG. 4 is a bottom view of the folding knife of FIG. 1 according to an exemplary embodiment.
Figure 5:
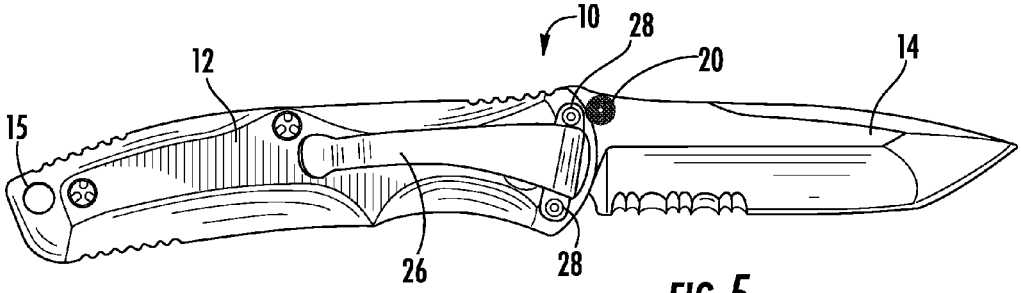
FIG. 5 is a right side view of the folding knife of FIG. 1 according to an exemplary embodiment.
Figure 6:
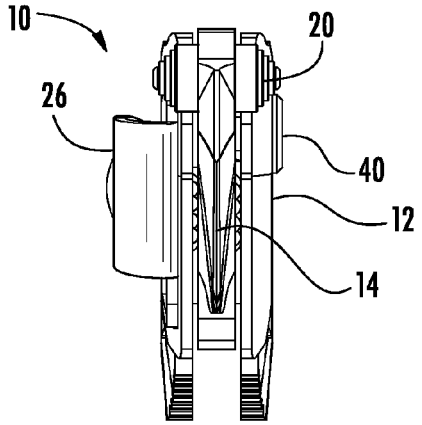
FIG. 6 is a front view of the folding knife of FIG. 1 according to an exemplary embodiment.
Figure 7:
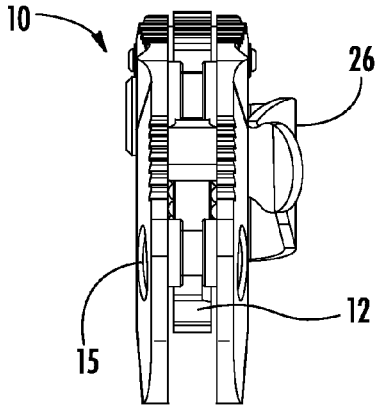
FIG. 7 is a rear view of the folding knife of FIG. 1 according to an exemplary embodiment.
Figure 8:
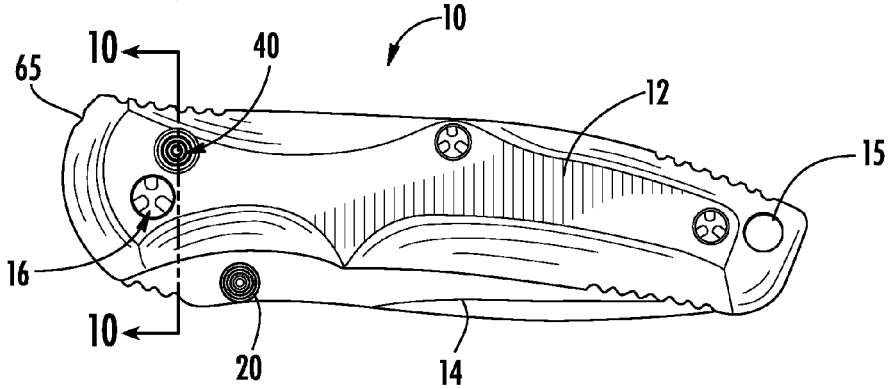
FIG. 8 is a left side view of the folding knife of FIG. 1 with the blade in a closed position according to an exemplary embodiment.

Referring to FIGS. 1-21, a folding tool, shown as folding knife 10, is shown according to an exemplary embodiment. Knife 10 includes a handle 12 having a first end pivotally coupled to an implement, shown as, but not limited to, blade 14. Blade 14 is coupled to handle 12 by a blade axle 16 that extends through a tang 50 of blade 14. A thumb stud 20 may extend outwardly from a portion of the blade for gripping by a user. According to an exemplary embodiment, thumb screw or stud 20 includes a first or female portion 19 and a second or male portion 21 that are configured to be coupled together (e.g., screwed) through a hole 11 in blade 14 (see, e.g., FIG. 11). According to the exemplary embodiment shown in the FIGS. 1-21, handle 12 also includes an opening shown as lanyard opening 15 located adjacent a second end of handle 12.

Figure 11:
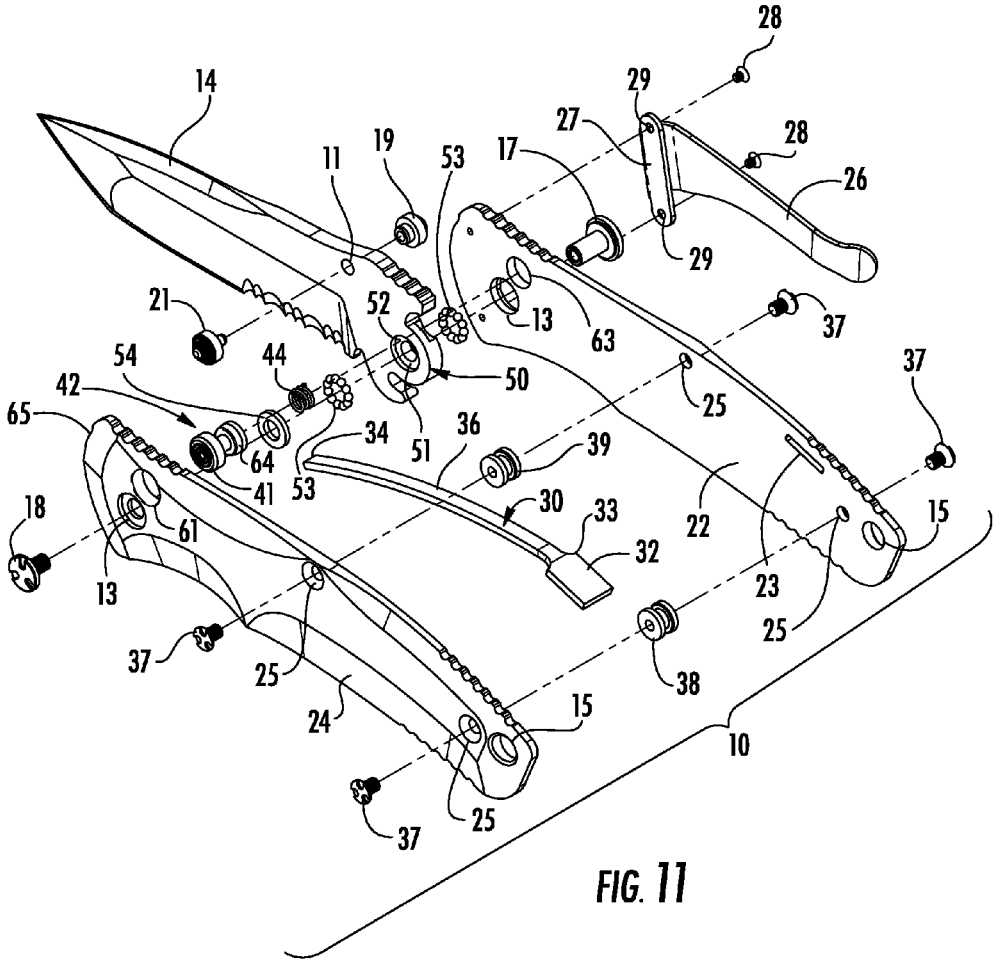
FIG. 11 is an exploded view of the folding knife of FIG. 1 according to an exemplary embodiment.

As shown in FIG. 11, according to an exemplary embodiment, handle 12 of folding knife 10 includes a pair of handle sides shown as first handle side 22 and second handle side 24. Fasteners shown as screws 37 are used to couple handle sides 22, 24 together. Screws 37 extend through holes or openings 25 in each handle side 22, 24. According to an exemplary embodiment, openings 25 include a beveled or recessed surface to accommodate a head of each screw 37. A first pair of screws 37 are received by a member shown as first barrel 38 while a second pair of screws 37 are received by a member shown as second barrel 39. Barrels 38, 39 have a generally hour glass shape or profile. Barrels 38, 39 also have internal threads at opposing ends to receive screws 37. Barrels 38, 39 are configured to space apart handle sides 22, 24 a predetermined distance (e.g., a distance equal to slightly greater than the thickness of blade 14).

According to an exemplary embodiment, knife 10 includes a clip 26 that is coupled (e.g., screwed) to one of the handle sides (e.g., handle side 22) of handle 12. Clip 26 includes an open end at a first end of clip 26 and a member or flange 27 at a second end of clip 26. Flange 27 includes a pair of openings 29 configured to receive fasteners shown as screws 28 in order to couple clip 26 to handle side 22.

As shown in FIG. 11, according to an exemplary embodiment, axle 16 includes a first portion 17 and a second portion 18. First and second portions 17, 18 extend through respective openings 13 in handle sides 22, 24 and also through opening 51 of tang 50 to rotationally or pivotally couple blade 14 to handle 12. According to the exemplary embodiment shown in FIG. 11, second portion 18 is configured to screw into first portion 17. However, according to other exemplary embodiments, first and second portions 17, 18 may be otherwise configured. Openings 13 in handle sides 22, 24 may also include a beveled or recessed portion to accommodate the head portions of first and second portions 17, 18.

Axle 16 is also shown to include a set of ball bearings 53 provided on either side of tang 50. Ball bearings 53 are configured to aid in the rotation of blade 14 when opening or closing blade 14. As shown in FIG. 11, according to an exemplary embodiment, ball bearings 53 are configured to be received in a cutout or recessed portion 52 of opening 51 of tang 50. Axle 16 may also include a member shown as bearing washer 54 to help retain ball bearings 53 in the proper position within knife 10.

Knife 10 also includes a member shown as a spring 30 (e.g., cantilever spring, leaf spring, cam spring, spring arm, etc.) provided between handle sides 22, 24. Spring 30 includes a first or proximal end 32 having an enlarged portion 33 (e.g., tab, projection, protrusion, extension, etc.). Enlarged portion 33 is shown to have a generally rectangular cross-sectional shape or profile; however, according to other exemplary embodiments, enlarged portion 33 may have a different cross-sectional shape. Spring 30 also includes a second or distal end 34 opposite first end 32 and an intermediate or middle portion 36 located in between first end 32 and second end 34.

According to an exemplary embodiment, spring 30 is coupled to handle 12 by having enlarged portion 33 engage with cutouts or slots 23 (e.g., pockets, compartments, slits, cuts, etc.) located in an interior side or surface of handle sides 22, 24. As such, first end 32 of spring 30 has a generally fixed position with respect to handle 12, while the position of second end 34 varies depending on the various positions of blade 14. In other words, the position of second end 34 varies with the specific degree of rotation of blade 14 during opening and closing of blade 14. According to other exemplary embodiments, spring 30 may be coupled to handle 12 in a different configuration.

According to an exemplary embodiment, knife 10 includes a locking/unlocking mechanism, shown as locking device 40 (e.g., a push button lock, a plunge lock, etc.). Locking device 40 is configured to interact with blade 14 (e.g., tang 50 of blade 14) to lock/unlock blade 14 from a fully open position. Locking device 40 includes a member shown as piston 42 that extends through an aperture 61 in handle side 24. Piston 42 includes a first end 41 and a second end 43. First end 41 may include a series of ridges or concentric circles provided on the exposed outer surface of first end 41. These ridges or concentric circles may aid a user in properly locating a finger or thumb when depressing piston 42 of locking device 40 (e.g., to unlock locking device 40).

According to an exemplary embodiment, second end 43 of piston 42 forms a cup 45 that is configured to receive a first end of a biasing member shown as coil spring 44. A second end of coil spring 44 is received in a cutout or recess 63 located in the inside surface of handle side 22. Piston 42 also includes a recess portion 46 provided between first end 41 and second end 43.

As discussed above, tang 50 of blade 14 includes an opening 51 configured to receive axle 16 (e.g., first and second portions 17, 18 of axle 16). Tang 50 also includes a first cutout 58 having a recess or recessed portion 59 (see, e.g., FIGS. 20-21). Tang 50 also includes a second cutout 55 provided generally opposite of first cutout 58 on tang 50. Second cutout 55 includes a recess or recessed portion 60. Tang 50 further includes an external curved or contoured surface 56 located adjacent second cutout 55. According to one exemplary embodiment, contoured surface 56 generally corresponds to second cutout 55. Contoured surface 56 includes a tip or tip portion 57 located adjacent a first edge of second cutout 55. Tang 50 further includes a radius 62 that extends from a second edge of second cutout 55 to a first edge of first cutout 58. According to one exemplary embodiment, radius 62 generally corresponds with opening 51.

Figure 12:
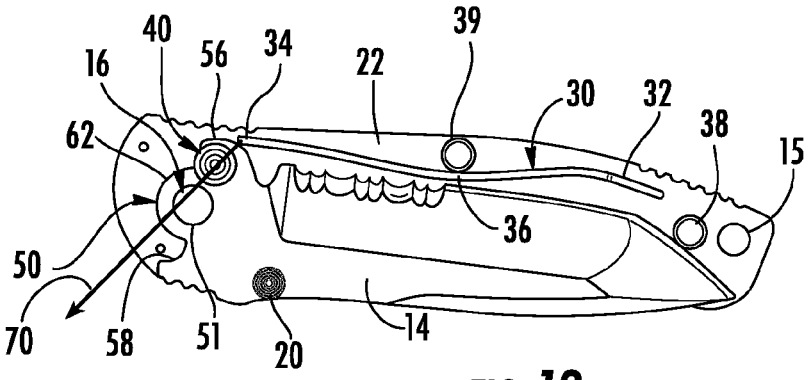
FIG. 12 is a cut-away left side view of the folding knife of FIG. 1 with the blade in the closed position according to an exemplary embodiment.

Referring specifically now to FIGS. 12-19, knife 10 is shown (with handle side 24 being removed for clarity) in various stages of opening and closing blade 14. As shown in FIG. 12, knife 10 is shown with blade 14 in a fully closed position. In the closed position, spring 30 exerts a force (e.g., a closing force) on blade 14. Specifically, second end 34 of spring 30 contacts contoured surface 56 of tang 50 to exert a counterclockwise (closing) force on contoured surface 56. This force (as seen by force vector 70 in FIG. 12) is created by spring 30 being bent or curved around a portion of second barrel 39 along or at intermediate portion 36 of spring 30. In other words, second barrel 39 exerts a bending force onto intermediate portion 36 of spring 30 to aid second end 34 to exert a closing force on contoured surface 56 of tang 50.

According to another exemplary embodiment, second barrel 39 is not required. In other words, second end 34 of spring 30 may be configured to exert a closing force on blade 14 without being bent around second barrel 39. For example, spring 30 may be shortened and coupled to handle sides 22, 24 in a location near the current location of second barrel 39 (or to a location other than that shown in FIGS. 12-19). It should be noted that by not using second barrel 39, force vector 70 would change. For example, the total amount of force exerted on blade 14 by spring 30 would be lower without second barrel 39. In other words, including second barrel 39 increase the spring force through shortening the lever arm of spring 30. Additionally, by not including barrel 39, the direction of force vector 70 would change.

Figure 13:
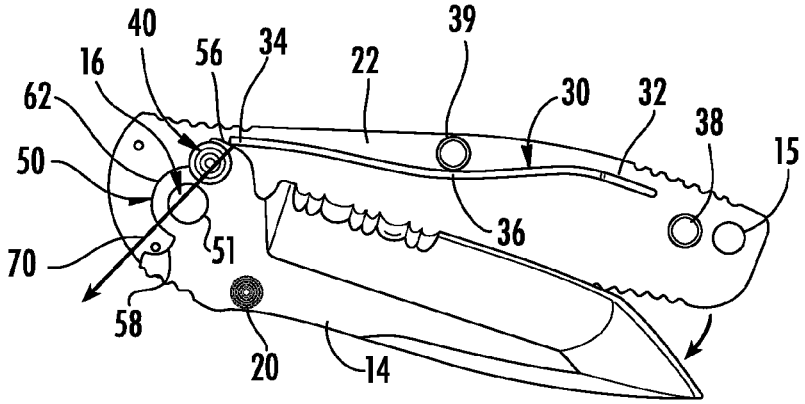
FIGS. 13-15 are cut-away left side views of the folding knife of FIG. 1 with the blade in partially opened positions according to an exemplary embodiment.
Figure 14:
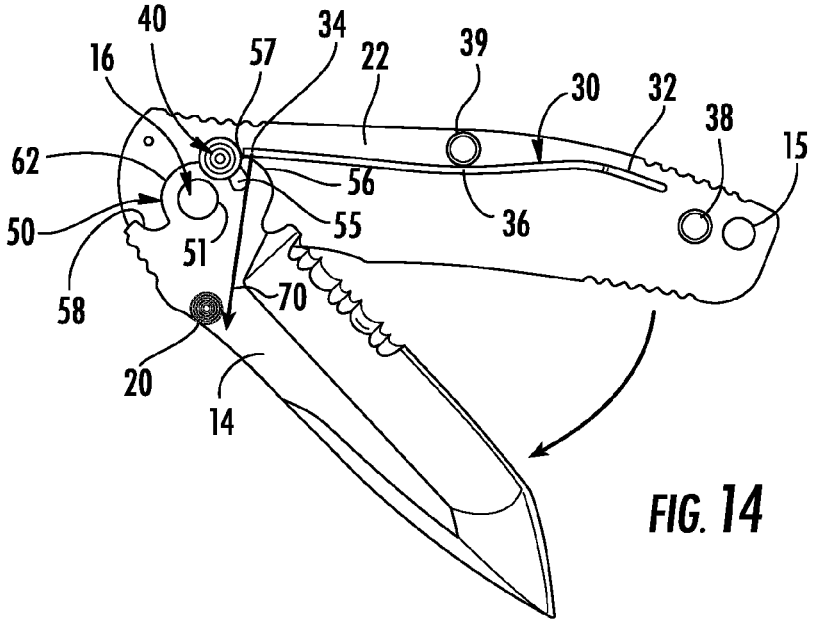

Referring to FIG. 13, as a user manually opens blade 14 by rotating blade 14 about axis 16 (e.g., by contacting thumb stud 20), second end 34 of spring 30 rides or travels along contoured surface 56, thus changing the point of tangency and the direction of force vector 70. As the second end 34 of spring 30 approaches tip 57 of contoured surface 56 (e.g., as shown in FIG. 14), force vector 70 crosses to the right-hand side (in the view of FIG. 14) of the centerpoint of blade axle 16, and the force exerted by spring 30 changes from a counterclockwise force to a clockwise force exerted on tang 50 of blade 14, thus biasing the blade 14 into the open position.

According to one exemplary embodiment, spring 30 exerts an opening force on blade 14 once blade 14 has been manually opened to a position approximately 30 degrees from the fully closed position. The number of degrees blade 14 must be manually opened prior to receiving assistance from spring 30 may be changed by altering contoured surface 56 of tang 50 to achieve the desired effect.

Figure 15:
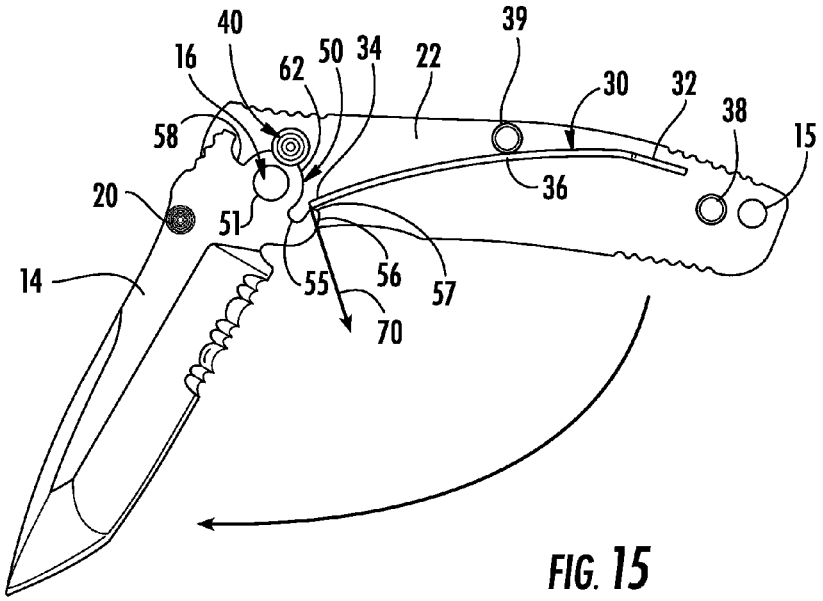

Referring to FIG. 15, spring 30 has traveled further along contoured surface 56 of tang 50 toward tip 57 and is nearing a position where second end 34 is no longer in contact with tang 50 of blade 14. Ideally, spring 30 is configured to drive blade 14 from the position shown in FIG. 15 into the fully opened position of FIG. 16 without further manual assistance or intervention by the user. In other words, the force generated on tang 50 of blade 14 starting at the position shown in FIG. 14 and continuing through to the position shown in FIG. 15 is great enough to automatically pivot or rotate blade 14 into the fully opened position of FIG. 16.

Figure 16:
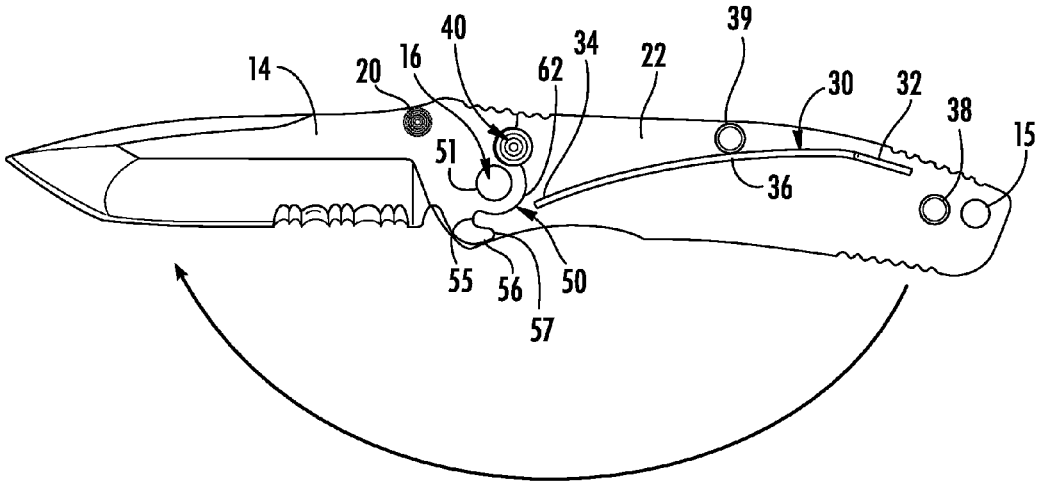
FIG. 16 is a cut-away left side view of the folding knife of FIG. 1 with the blade in a fully opened and locked position according to an exemplary embodiment.

Referring now to FIG. 16, once blade 14 is in the fully opened position, locking device 40 engages blade 14 to prevent blade 14 from unintentionally rotating out of the open position. According to one exemplary embodiment, piston 42 of locking device 40 engages cutout 58 of tang 50. Specifically, recess 59 of cutout 58 is engaged or retained by an outside portion 64 of cup 45 of piston 42 (e.g., as seen in FIG. 9) such that movement of blade 14 is substantially restricted.

Figure 9:
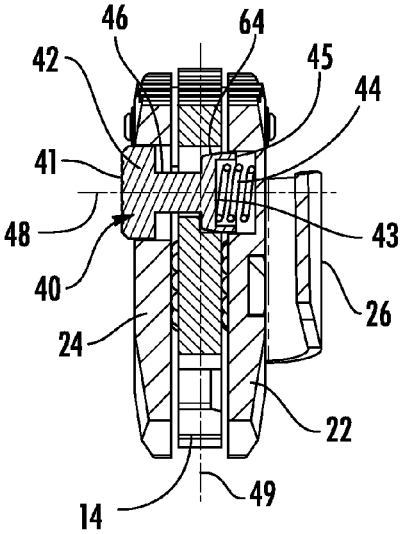
FIG. 9 is a cross-sectional view taken along line 9-9 of the folding knife of FIG. 3 according to an exemplary embodiment.

As shown in FIG. 9, spring 44 exerts a biasing force on cup 45 of piston 42 in a direction along an axis 48, which is shown to be generally perpendicular to a plane 49 defined by blade 14. As such, as soon as blade 14 reaches the fully open position (and recess 59 aligns with outer portion 64 of cup 45), locking device 40 automatically moves into the locked position (as shown in FIG. 9). The engagement of outer portion 64 of cup 45 within recess 59 substantially restricts movement of blade 14 (i.e., blade 14 is not allowed to close when the locking device is in the locked position).

In the position depicted in FIG. 16, spring 30 is no longer in contact with tang 50 and therefore provides no biasing force on blade 14. As such, spring 30 is shown in its relaxed position or free state position and has a generally curved profile. However, according to another exemplary embodiment, spring 30 may be alternatively configured to maintain contact with tang 50 in the fully opened position, and to also exert a biasing force on blade 14 in the open position.

In order to close blade 14 from the fully opened position shown in FIG. 16, a user must disengage locking device 40 from the locked position shown in FIG. 9 to an unlocked position or fully retracted position (not shown). For example, a user may depress or push in on first end 41 of piston 42 to move piston 42 against the force exerted by spring 44 along axis 48 to move locking device 40 from the locked position into the unlocked position. By depressing piston 42, recess portion 46 is brought into alignment with recess 59 of cutout 58 of tang 50, permitting rotation of blade 14 and allowing the user to rotate or pivot blade 14.

Figure 17:
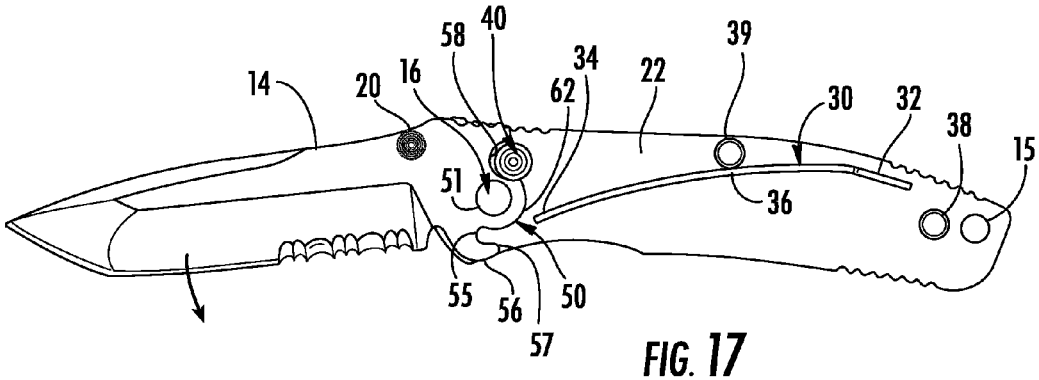
FIGS. 17-19 are cut-away left side views of the folding knife of FIG. 1 with the blade in partially closed positions according to an exemplary embodiment.

Once blade 14 is partially moved from the fully opened position (e.g., as shown in FIG. 17), outside portion 64 of cup 45 is in contact with radius 62 of tang 50. Radius 62 forces locking device 40 (by contacting outside portion 64 of cup 45) into the unlocked position while the blade is moved from the fully opened position to the fully closed position. While locking device 40 is in the fully retracted position, the user may release pressure on piston 42 of locking device 40, as outside portion 64 of cup 45 is held in place by radius 62.

Figure 18:
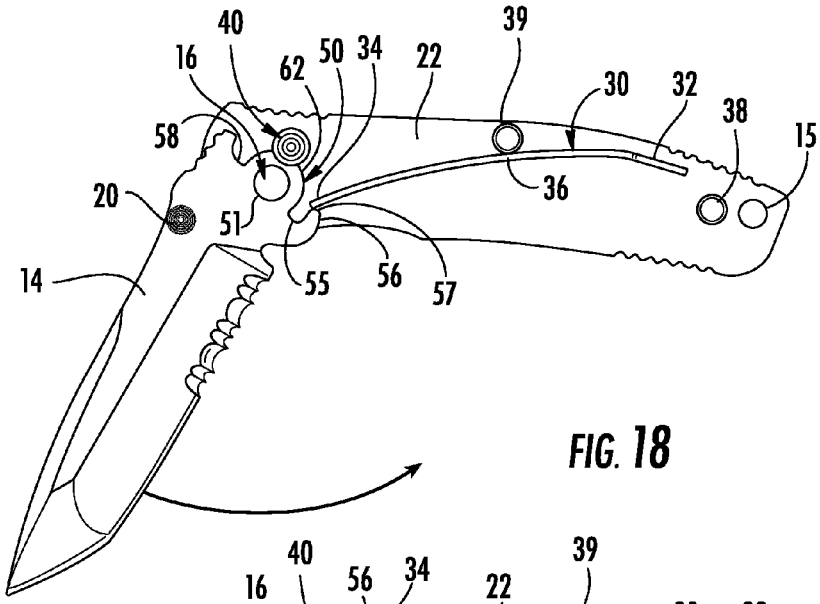

Referring to FIG. 18, as a user closes blade 14, tip 57 of tang 50 contacts second end 34 of spring 30 and forces second end 34 upward (in the view of FIG. 18) against the bias of spring 30. Second end 34 will then travel along contoured surface 56 as the blade 14 is moved to the closed position. As blade 14 nears the fully closed position, as shown in FIG. 19, spring 30 begins exerting a counterclockwise force on blade 14, thus moving blade 14 into the fully closed position (as seen in FIG. 12).

Figure 19:
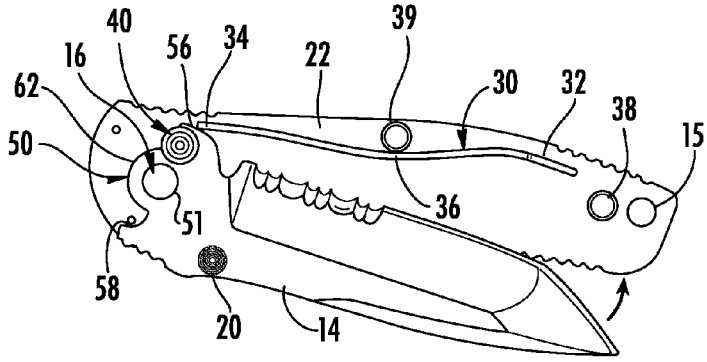
Figure 20:
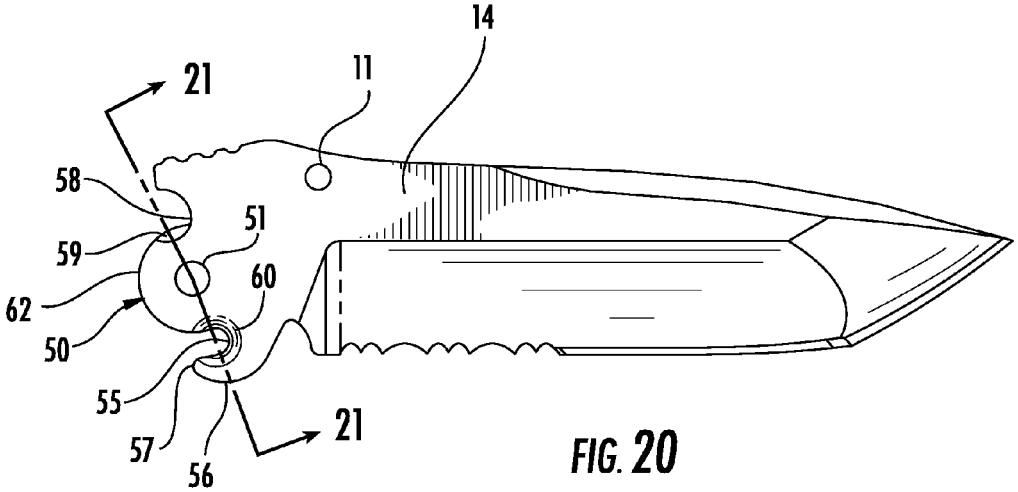
FIG. 20 is a right side view of the blade of the folding knife of FIG. 1 according to an exemplary embodiment.
Figure 21:
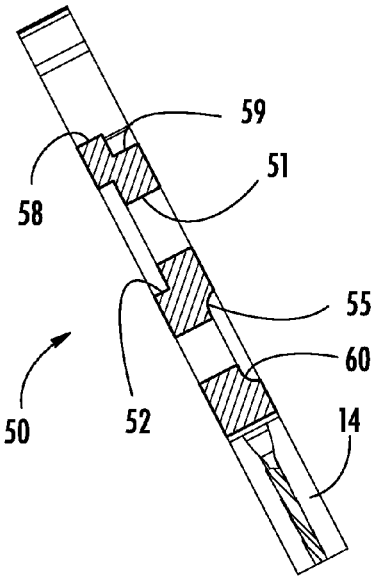
FIG. 21 is a cross-sectional view taken along line 21-21 of the blade of FIG. 20 according to an exemplary embodiment.
Figure 22:
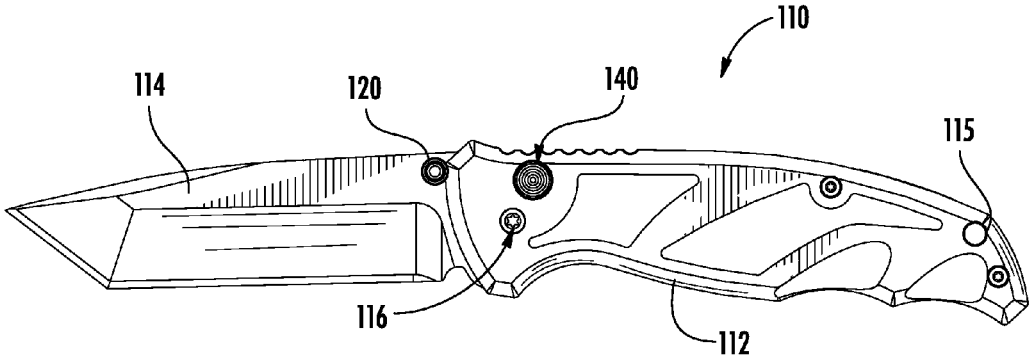
FIG. 22 is a left side view of a folding knife according to another exemplary embodiment.
Figure 23:
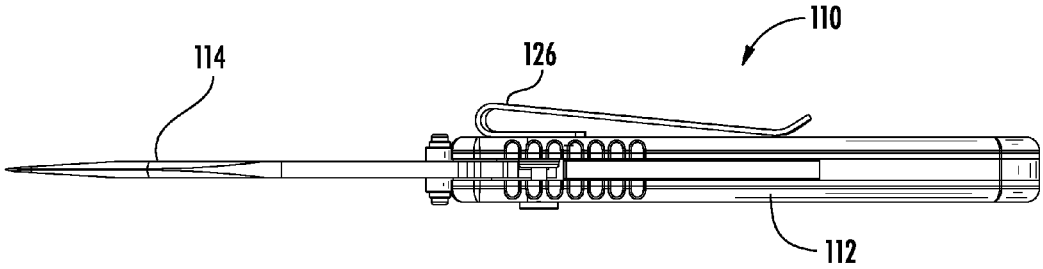
FIG. 23 is a top view of the folding knife of FIG. 22 according to an exemplary embodiment.

Accordingly, although a user initially moves or forces the blade 14 into the closed position against the bias of spring 30 (e.g., as shown in FIG. 18), once the blade 14 is near the fully closed position (e.g., as shown in FIG. 19), the interaction between spring 30 and contoured surface 56 moves the blade 14 into the fully closed position (e.g., as shown in FIG. 13). As such, spring 30 maintains the blade 14 in the closed position by exerting a closing force on tang 50 of blade 14 to prevent accidental opening of blade 14.

Figure 10:
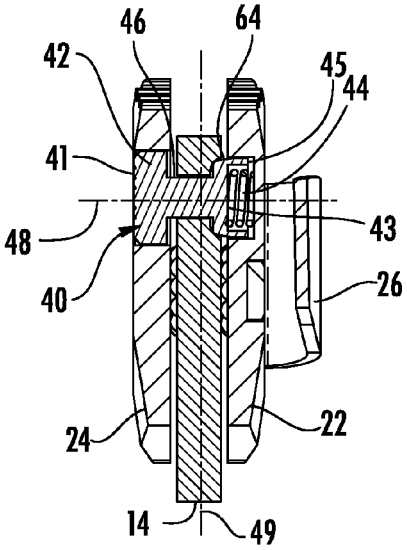
FIG. 10 is a cross-sectional view taken along line 10-10 of the folding knife of FIG. 8 according to an exemplary embodiment.

Once blade 14 is in the fully closed position (as shown in FIG. 12), locking device 40 moves to an intermediate position as shown in FIG. 10. Specifically, piston 42 of locking device 40 moves along axis 48 once outside portion 64 of cup 45 is aligned with recess 60 of cutout 55. According to an exemplary embodiment, first end 41 of piston 42 is generally flush with an outside surface of handle side 24 when locking device 40 is in the intermediate position. In the intermediate position, outside portion 64 of cup 45 of piston 42 contacts at least a portion of recess 60 of cutout 55 to exert a biasing force on blade 14. This biasing force is in a direction generally along axis 48, which is generally perpendicular to plane 49 defined by blade 14.

The biasing force helps to keep or retain blade 14 in the closed position (until a user begins to manually open blade 14). For example, the biasing force acts to push or compress a side of tang 50 (and thus blade 14) against an inside face of handle side 24. According to an exemplary embodiment, the biasing force exerted by piston 42 of locking device 40 acts in combination with the biasing force exerted by spring 30 on tang 50 to aid in keeping or biasing blade 14 in the fully closed position. However, recess 60 and cutout 55 are configured such that a user does not have to depress piston 42 of locking device 40 before beginning to open blade 14. In other words, locking device 40 automatically moves to the unlocked or fully retracted position once the user starts to open blade 14.

According to the exemplary embodiment shown in FIG. 10, when locking device 40 is in the intermediate position, a small gap exists between an end or tip of cup 45 and an inside or bottom face of cutout 63. This gap substantially decreases (or disappears altogether) once blade 14 is moved from the fully closed position (and when locking device 40 is moved to the unlocked position), causing radius 62 to contact outside portion 64 of cup 45. However, once blade 14 is in the fully opened position, a gap (e.g., as shown in FIG. 9) again exists between the end of cup 45 and the inside or bottom face of cutout 63.

Referring to FIGS. 9 and 10, according to an exemplary embodiment, locking device 40 is biased in a locked position (e.g., as shown in FIG. 9) or an intermediate position (e.g., as shown in FIG. 10) by spring 44, which is shown as a coil spring. As such, locking device 40 automatically moves or slides into its locked position when blade 14 is fully opened or into its or intermediate position when blade 14 is fully closed. In another embodiment, locking device 40 may be biased or braced into its locked or intermediate positions by a spring other than a coil spring, or by any other suitable device.

According to the exemplary embodiment shown in FIGS. 1-21, the width of spring 30 is substantially the same as the width of blade 14. Additionally, spring 30 is installed directly in the plane defined by blade 14 (e.g., plane 49 shown in FIGS. 9-10). That is, spring 30 and blade 14 are in the same plane. The utilization of spring 30 directly in the plane of blade 14 (and having a width approximately equal to blade 14) rather than disposed outside of the plane of the blade permits folding knife 10 to be less bulky (e.g., less thick) than other designs, which require additional space inside the handle to accommodate the mechanism. Further, since spring 30 also functions to bias blade 14 in a closed position, space within handle sides 22, 24 is further efficiently utilized due to the lack of an additional mechanism to lock the blade in the closed position. That is, an additional mechanism to lock the blade in the closed position is not required.

As shown in FIG. 11, spring 30 may be coupled to handle sides 22, 24 via enlarged portion 33 of first end 32 of spring 30 fitting within cutouts or slots 23. This configuration may be altered depending on the specific configuration of the folding knife, such as by the use of other attachment mechanisms known in the art to attach the spring and handle components.

According to an exemplary embodiment, blade 14 stops rotating in the opening direction when thumb stud 20 engages one or both handle sides 22, 24. For example, thumb stud 20 may engage or contact a feature shown as an indentation 65 located adjacent the first end of handle sides 22, 24 (such as, e.g., shown in FIG. 8). However, other configurations are possible, as other ways of preventing over-rotation of the blade are well known in the folding knife art. For example, a member or pin (such as, e.g., a stop pin) separate from piston 42 of locking device 40 may be provided (e.g., between handle sides 22, 24) to stop the opening rotation of blade 14. According to another exemplary embodiment, piston 42 of locking device 40 may be provided to stop the opening rotation of blade 14. In other words, the opening rotation of blade 14 may be stopped by having an edge of cutout 58 contact piston 42 of locking device 40.

According to an exemplary embodiment, piston 42 of locking device 40 is provided to stop the closing rotation of blade 14. In other words, the closing rotation of blade 14 is stopped by having an edge of cutout 55 (e.g., recess 60) contact piston 42 (e.g., outside portion 64 of cup 45) of locking device 40. In this embodiment, a tip of blade 14 is nested within the recess created by the hour glass profile of first barrel 38. However, other configurations are possible, as other ways of preventing stopping closing rotation of the blade are well known in the folding knife art. For example, a member or pin (such as, e.g., a stop pin) separate from piston 42 of locking device 40 may be provided (e.g., between handle sides 22, 24) to stop the closing rotation of blade 14. Additionally, one or more of the barrels may be used to stop the closing rotation of blade 14.

In an alternative embodiment, the folding knife may be configured to have the assisted opening feature described herein, but not the blade lock mechanism. Instead, the contoured surface of the blade tang may be configured such that the spring provides a bias on the blade tang when the blade is in the fully open position to aid in maintaining the blade in the fully open position.

It should also be noted that the specific size and location of several components within the folding knife help to determine the overall size of the folding knife. For example, the location of spring 30 (including the location of where first end 32 is coupled to handle sides 22, 24) is one factor in determining the overall size of knife 10. By keeping knife 10 (including the handle 12) as compact as possible, the overall product is more marketable. Further, by incorporating a push or plunge locking device (such as locking device 40) in combination with a cantilever spring assisted opening feature (such as with spring 30 and tang 50), a folding knife can be produced having consumer desired features (assisted opening, plunge lock, compact size), but at a reasonable cost (due to savings and efficiency during manufacturing).

For example, by not having spring 30 contact blade 14 when in the fully opened position (and therefore not bias the blade in the open position), manufacturing tolerances can be increased, making it easier and less expensive to create numerous components of knife 10. Additionally, by not having locking device 40 act as an opening stopping device (by having thumb stud 20 or other device act as the opening stopping device), the manufacturing tolerances of locking device 40 can be increased, again making it easier and less expensive to create numerous components of knife 10.

Referring now to FIGS. 22-28, a folding tool shown as folding knife 110 is shown according to another exemplary embodiment. While the embodiment shown in FIGS. 22-28 is similar to the embodiment shown in FIGS. 1-21 (with similar features labeled with corresponding reference numbers in the 100 series), additional or dissimilar features will be briefly described below.

Figure 24:
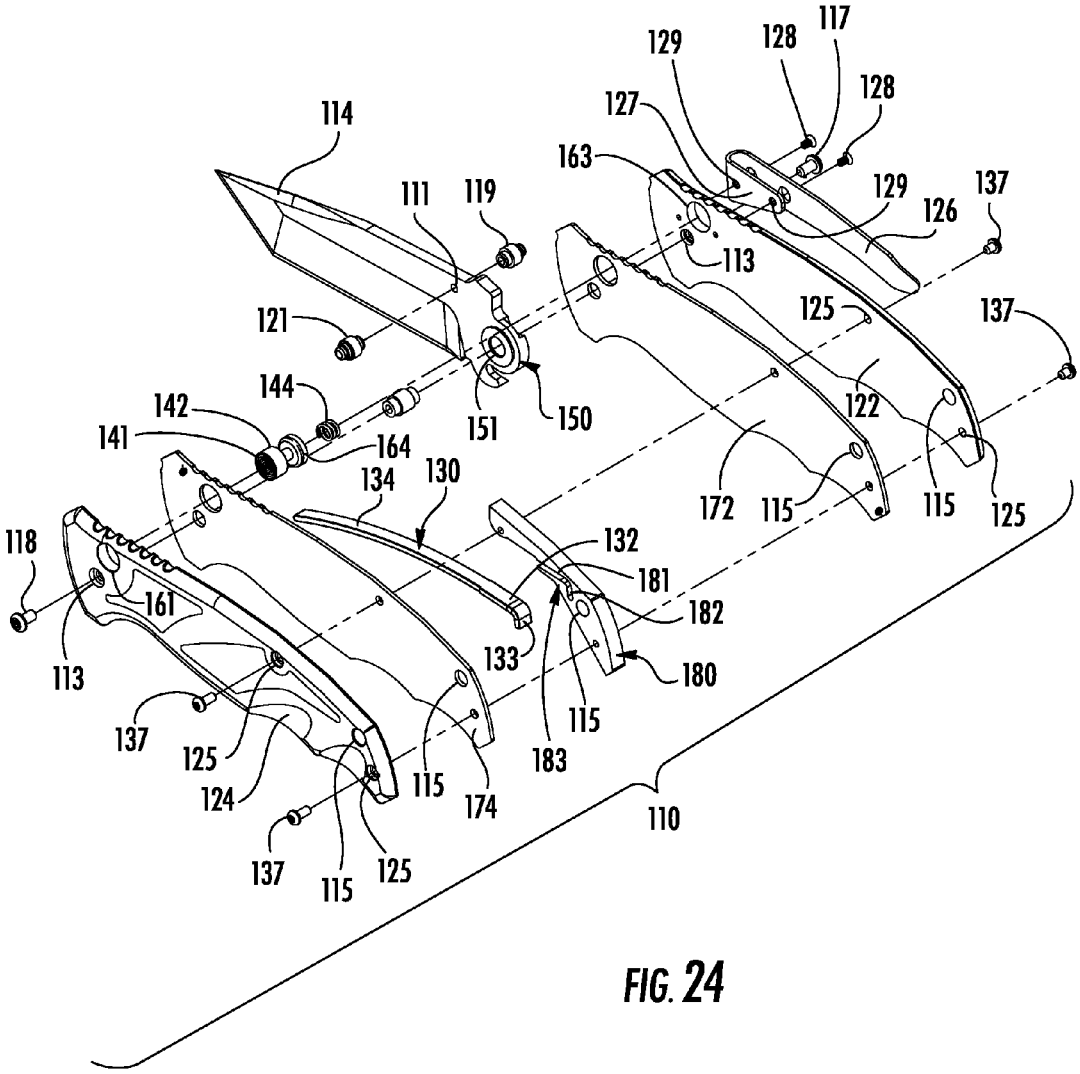
FIG. 24 is an exploded view of the folding knife of FIG. 22 according to an exemplary embodiment.

Referring to FIG. 24, folding knife 110 includes a member shown as a bridge 180. Bridge 180 is configured to be provided between handle liners 172, 174. Bridge 180 includes various holes or openings configured to receive fasteners (such as screws 137) in which to couple handle sides 122, 124 and liners 172, 174 together to form handle 112. Bridge 180 also includes a lanyard hole 115 (which also corresponds with lanyard holes 115 in handle sides 122, 124 and liners 172, 174).

According to the exemplary embodiment shown in FIG. 24, bridge 180 includes a recess or slot 183 (e.g., opening, cutout, groove, etc.). Slot 183 includes a first portion 181 and a second portion 182. As shown in FIG. 24, second portion 182 extends from first portion 181 at a generally right angle. However, according to other exemplary embodiments, slot 183 may be otherwise configured. According to one exemplary embodiment, slot 183 is created by a machining process, although any suitable process may be used to create slot 183 according to other exemplary embodiments.

Slot 183 is configured to receive a first end 132 of spring 130 (e.g., as shown in FIGS. 25-28). Specifically, a bent portion 133 of first end 132 of spring 130 is configured to be received by second portion 182 of slot 183, while a portion of first end 132 is configured to be received by first portion 181 of slot 183. When bridge 180 is coupled within handle 112, bridge 180 substantially fixes or retains first end 132 of spring 130 with respect to handle 112. However, a second end 134 of spring 130 is allowed to move within handle 112 to exert an opening or closing force on blade 114, depending on the relative position of blade 114.

Figure 25:
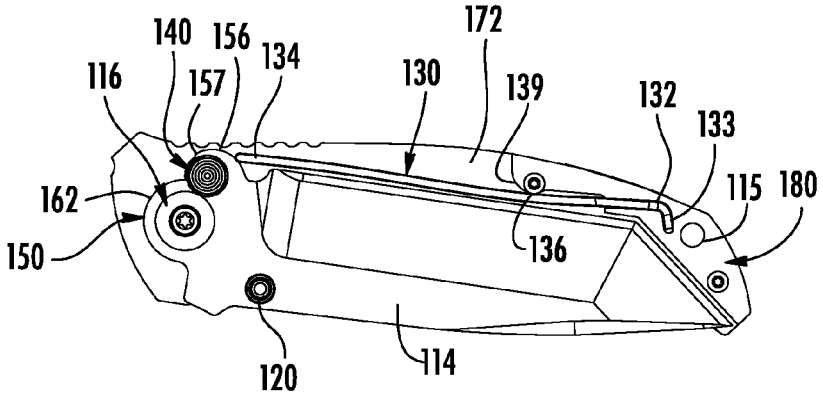
FIG. 25 is a cut-away left side view of the folding knife of FIG. 22 with the blade in the closed position according to an exemplary embodiment.
Figure 26:
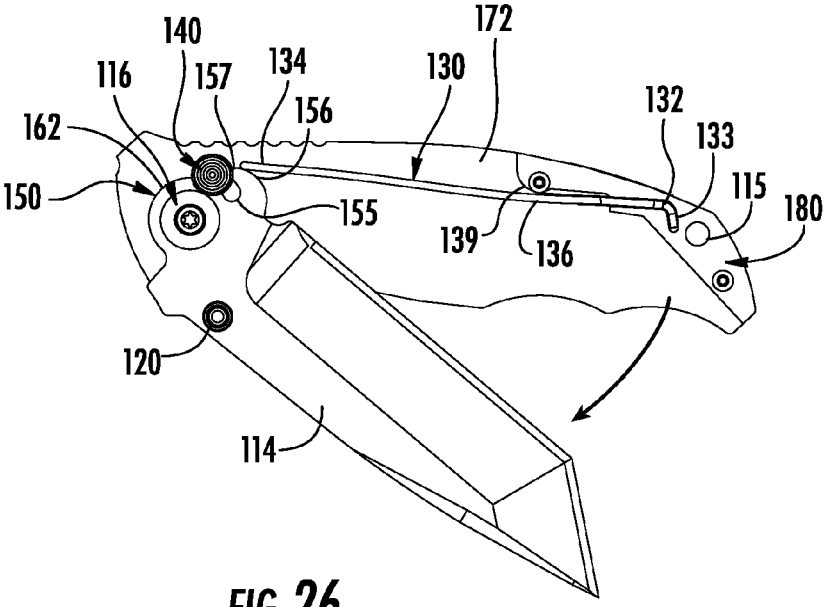
FIGS. 26-27 are cut-away left side views of the folding knife of FIG. 22 with the blade in partially opened positions according to an exemplary embodiment.
Figure 27:
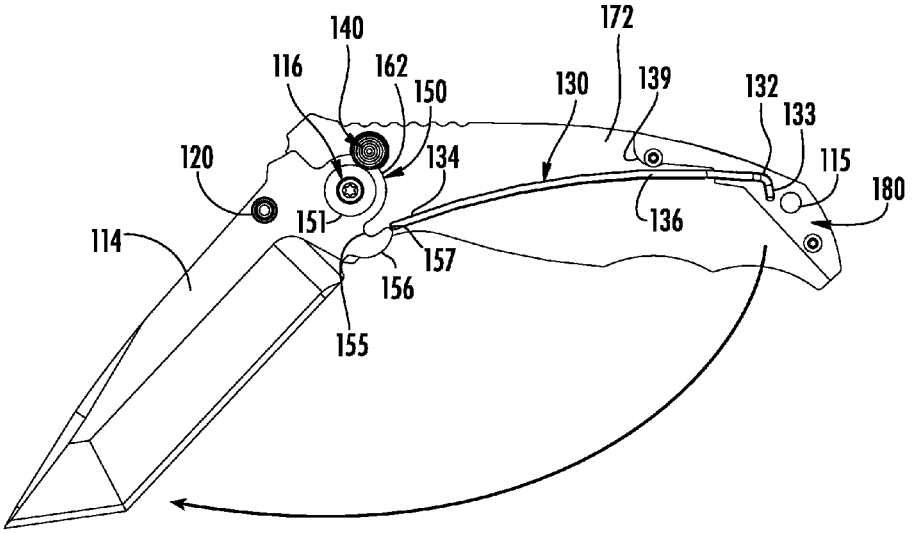
Figure 28:
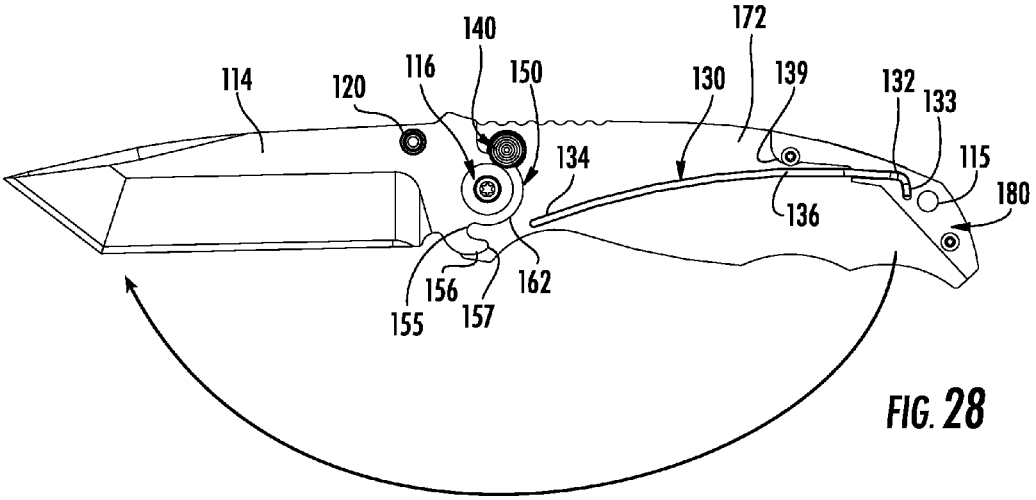
FIG. 28 is a cut-away left side view of the folding knife of FIG. 22 with the blade in a fully opened and locked position according to an exemplary embodiment.

For example, as shown in FIG. 25, second end 134 of spring 130 contacts a contoured portion 156 of tang 150 to exert a closing force on blade 114. Additionally, as shown in FIG. 25, spring 130 is bent or curved around feature 139 of bridge 180 to aid in creating this closing force. However, as blade 114 is opened, as shown in FIG. 26 (e.g., by a user manually pushing down on blade 114 or a thumb stub 120), second end 134 of spring 130 travels along contoured surface 156 towards tip 157 to now exert an opening force on tang 50 of blade 114. This opening force continues until blade 114 reaches the position shown in FIG. 27, where second end 134 is just about to no longer be in contact with tip 157 of contoured surface 156. From the position shown in FIG. 27, blade 114 automatically continues to a fully opened position, as shown in FIG. 28. Closing blade 114 may be carried out in a similar fashion as described for the embodiment shown in FIGS. 1-21.

It should be noted that certain features of any of the embodiments shown in FIGS. 1-28 and described above may be used in combination with or in exclusion to other certain features of these embodiments. For example, liners 172, 174 may be used with the embodiment shown in FIGS. 1-21. Alternatively, bridge 180 may be used without liners 172, 174.

The components depicted in the figures are constructed of materials known in the folding tool art. Typically, the liners (if present), the handle sides, and the clip are constructed from a metallic material (such as a titanium or titanium alloy). The spring (such as spring 30, 130) may be constructed from a stainless steel alloy and also may have a spring temper to maintain the proper biasing forces discussed above. Additionally, according to one exemplary embodiment, the spring is of a configuration and material chosen to match the hardness of the blade. The various fasteners, screws and other components may be made from various stainless steel alloys. According to other exemplary embodiments, other suitable materials may be used for the various components of the folding knife. For example, if liners are used (e.g., metallic liners), the handles may be a non-metallic material (e.g., a plastic or polymer material). Additionally, if a bridge member is used, the bridge may be constructed from aluminum (e.g., anodized aluminum) or other suitable material.

While the detailed drawings and specific examples given describe various exemplary embodiments of the folding knife, they serve the purpose of illustration only. It is to be understood that the invention is not limited in its application to the details of construction and the arrangements of components set forth in the preceding description or illustrated in the drawings. For example, the folding knife may have multiple blades and may include multiple springs configured to assist the opening of those blades and lock the blades into the open position. The space-saving mechanism of the present invention may permit the use of such multiple blades where other folding knives having similar functionality would be too bulky to do so. Rather than a blade, another implement such as a saw may be substituted and have the same functionality. Furthermore, other substitutions, modifications, changes, and omissions may be made in the design, operating conditions, and arrangements of the exemplary embodiments without departing from the scope of the invention as expressed in the appended claims.

What is claimed is:

1. A folding tool, comprising:

a handle;

an implement pivotally coupled to the handle, the implement adapted to travel between a closed position and an open position, the implement comprising a tang, wherein the tang includes a cutout defined in part by a hook-shaped arm;

a locking device movable between a locked position and an unlocked position along an axis transverse to a plane defined by the implement, wherein the locking device secures the implement in the open position when the locking device is in the locked position, and wherein the locking device is positioned within the cutout in the tang when the implement is in the closed position; and a cantilever spring having a first end coupled to the handle and a second end adapted to interact with the tang of the implement, wherein the spring exerts a closing force on the hook-shaped arm of the implement when the implement is in the closed position, wherein the spring exerts an opening force on the hook-shaped arm of the implement during at least a portion of the travel of the implement between the closed position and the open position, and wherein the spring does not contact the implement when the implement is in the open position.

2. The folding tool of claim 1, wherein the locking device comprises a piston configured to engage a first cutout of the tang when the locking device is in the locked position to lock the implement in the open position.

3. The folding tool of claim 2, wherein the locking device must be manually disengaged from the locked position to the unlocked position to disengage the piston from the first cutout of the tang prior to rotation of the implement into the closed position.

4. The folding tool of claim 2, wherein the piston is configured to engage a second cutout of the tang when the implement is in the closed position.

5. The folding tool of claim 4, wherein the piston is configured to exert a biasing force on the implement in a direction generally perpendicular to the plane defined by the implement to aid in biasing the implement in the closed position.

6. The folding tool of claim 4, wherein the piston is configured to act as a stopping device when the implement is in the closed position.

7. The folding tool of claim 1, further comprising a member configured to act as a stopping device when the implement is in the open position.

8. The folding tool of claim 7, wherein the member configured to act as a stopping device is a thumb stud that is coupled to the implement.

9. The folding tool of claim 1, wherein the tang includes a contoured surface and wherein the second end of the spring contacts a tip of the contoured surface to exert the opening force on the implement.

10. The folding tool of claim 1, wherein the implement is a blade.

11. The folding tool of claim 1, wherein the spring is positioned in the plane defined by the implement.

12. A folding knife, comprising:

a handle;

a blade pivotally coupled to the handle, the blade movable between a closed position and an open position, the blade having a tang and a thumb stud, the tang including a cutout defined in part by a hook-shaped arm, wherein contact between the handle and the thumb stud stops the blade in the open position;

a locking device movable between a locked position and an unlocked position along an axis generally perpendicular to a plane defined by the blade, wherein the locking device secures the blade in the open position when the locking device is in the locked position, wherein contact between the tang and the locking device stops the blade in the closed position, and wherein the locking device is positioned within the cutout in the tang when the blade is in the closed position; and a spring located in the plane defined by the blade, the spring having a proximal end coupled to the handle and a distal end adapted to exert a force on the blade via contact with the tang.

13. The folding knife of claim 12, wherein the spring exerts a closing force on the hook-shaped arm of the blade when the blade is in the closed position and an opening force on the hook-shaped arm of the blade when the blade is rotated several degrees away from the closed position.

14. The folding knife of claim 12, wherein the locking device is configured to exert a biasing force on the blade in a direction generally perpendicular to the plane defined by the blade to aid in biasing the blade in the closed position.

15. The folding knife of claim 12, wherein the proximal end of the spring comprises an enlarged portion.

16. The folding knife of claim 15, wherein the handle comprises a first handle side and a second handle side, each of the first and second handle sides having a cutout to receive a portion of the enlarged portion of the spring.

17. The folding knife of claim 15, wherein the enlarged portion of the spring has a generally rectangular profile.

18. The folding knife of claim 12, wherein the spring does not contact the blade when the blade is in the open position.

19. A folding knife, comprising:

a handle;

a blade pivotally coupled to the handle, the blade movable between a closed position and an open position, the blade having a tang, the tang including an arm having a contoured surface, the arm in part defining a cutout;

a locking device movable between a locked position and an unlocked position along an axis generally perpendicular to a plane defined by the blade, wherein the locking device secures the blade in the open position when the locking device is in the locked position, wherein the locking device is positioned within the cutout in the tang when the blade is in the closed position; and a spring located in the plane defined by the blade, the spring having a proximal end coupled to the handle and a distal end, wherein the distal end of the spring contacts the contoured surface of the arm to exert a closing force on the blade when the blade is in the closed position, and wherein the distal end of the spring does not contact the blade when the blade is in the open position.

* * * * *